US007285019B2

(12) United States Patent
Sakai et al.

(10) Patent No.: US 7,285,019 B2
(45) Date of Patent: Oct. 23, 2007

(54) POWER SUPPLY TERMINAL HAVING AN ELECTRONIC PART

(75) Inventors: Shuhei Sakai, Kawasaki (JP); Setsuo Kojima, Kawasaki (JP); Yoko Murata, Kawasaki (JP); Kazuya Orui, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 348 days.

(21) Appl. No.: 10/773,782

(22) Filed: Feb. 5, 2004

(65) Prior Publication Data

US 2004/0161975 A1 Aug. 19, 2004

(30) Foreign Application Priority Data

Feb. 7, 2003 (JP) ..... 2003-031491
Jan. 14, 2004 (JP) ..... 2004-006330

(51) Int. Cl.
*H01R 13/66* (2006.01)
*H01R 33/945* (2006.01)

(52) U.S. Cl. ..... 439/620.09; 439/709; 439/723

(58) Field of Classification Search ..... 439/620.15, 439/620.24, 620.25, 801, 721, 723, 78, 709, 439/620.09, 620.13, 620.1, 620.14, 733.1
See application file for complete search history.

(56) References Cited

U.S. PATENT DOCUMENTS 4,790,764 A * 12/1988 Kawaguchi et al. ..... 439/78
4,924,213 A * 5/1990 Decho et al. ..... 340/653
5,895,293 A * 4/1999 Brandberg et al. ..... 439/620.09
6,176,747 B1 * 1/2001 Rowe et al. ..... 439/721
6,224,430 B1 * 5/2001 Kusuda et al. ..... 439/709
6,807,066 B2 * 10/2004 Hayama et al. ..... 361/788

FOREIGN PATENT DOCUMENTS

JP 2000-251977 9/2000
WO WO 01/99237 A1 12/2001

* cited by examiner

*Primary Examiner*—Hae Moon Hyeon
(74) *Attorney, Agent, or Firm*—Katten Muchin Rosenman LLP

(57) ABSTRACT

A power supply terminal for supplying power to a BWB, the power supply terminal including a first terminal member having a pair of engaging holes; a press fit terminal in a U-shape inserted into slits of the first terminal member and having a plurality of press fit pins formed at an end portion of the press fit terminal. The power supply terminal further includes a second terminal member having a pair of engaging projections, the second terminal member being attached to the first terminal member by engaging the engaging projections with the engaging holes; and an electronic part having a pair of plate springs joined to both end portions of the electronic part, the electronic part being attached to the second terminal member by inserting the plate springs into of the second terminal member slits, and the elastic deforming part of each of the plate springs being pressure-contacted with the press fit terminal when the second terminal member is attached to the first terminal member.

8 Claims, 14 Drawing Sheets

POWER SUPPLY TERMINAL HAVING AN ELECTRONIC PART

BACKGROUND OF THE INVENTION

1. Field of the Invention

The present invention relates to a power supply terminal having a noise filter part and a back wiring board (BWB) assembly using the power supply terminal.

2. Description of the Related Art

With recent progress and development of various communication systems, such as cellular telephones and the Internet, in various forms, the amount of information handled by the various communication systems has been continuing to increase in various forms. There is a tendency to require of the various communication systems higher information density, higher transmission capacity, and higher-level functions. In order to satisfy these requirements, communication apparatus forming the various communication systems tend to consume more power. Hence, the communication apparatus need to be configured so as to withstand a large current. At the same time, to process high-density and high-frequency signals, the number of layers in the structure of a back wiring board (BWB) included in each communication apparatus is increasing steadily and also the BWB tends to be increasingly thickened.

Typically a power supply terminal is connected to the BWB of such a communication apparatus by using a press fit terminal without soldering. A typical conventional power supply terminal includes a crimp contact for supplying power, a press fit terminal inserted into the BWB, and a terminal member (terminal block) where part of the press fit terminal is housed. The crimp contact is electrically connected to the press fit terminal by a screw. The power supply terminal is inserted into the BWB from one side of the BWB. A plurality of capacitors for forming a noise filter circuit are mounted on an underside of the BWB with respect to a direction of the insertion of the power supply terminal. The noise filter circuit is provided for measures against EMI. For example, noise caused to a power supply line might adversely affect another apparatus connected to the same power supply line.

IEC international standards are set to deal with this problem. Although the IEC standards are used as they are in Europe, various countries adopt their own standards; for example, Japan adopts VCCI standards and the U.S. adopts FCC standards. In the method of connecting the conventional power supply terminal as described above, the capacitors included in the noise filter circuit are mounted directly on the BWB. Therefore, if this BWB warps when the press fit terminal is inserted into or pulled out of the BWB, when an electronic circuit package is inserted into or pulled out of a connector mounted on the BWB, or when the BWB is fitted on an enclosure for the apparatus, a capacitor included in this noise filter circuit will be damaged.

Furthermore, parts such as connectors or the like which cannot withstand reflow soldering are mounted on the BWB. In consideration of efficiency in work performed to mount parts on the BWB, the capacitors included in the noise filter circuit are mounted on the BWB by manual soldering with a soldering iron. Therefore, a capacitor included in this noise filter circuit may be damaged also by thermal stress at the time of this soldering.

A power supply terminal that overcomes these problems is disclosed in International Publication No. WO01/99237 of an application by the present applicant. In the power supply terminal described in the international publication, capacitors are mounted on a noise filter circuit board separate from a BWB by reflow soldering, and the noise filter circuit board is soldered to press fit terminals and housed in a terminal member.

However, the above power supply terminal described in the international publication is poor in manufacturability because the noise filter circuit board is attached to the press fit terminals by soldering. In addition, the power supply terminal is of a large size because the terminal member needs to be provided with a region for housing the noise filter circuit board.

SUMMARY OF THE INVENTION

It is accordingly an object of the present invention to provide a manufacturable and compact power supply terminal for supplying power to a BWB.

It is another object of the present invention to provide a power supply terminal that facilitates replacement, change, and the like of an electronic circuit part even after the power supply terminal is mounted on a BWB.

In accordance with an aspect of the present invention, there is provided a power supply terminal for supplying power to a back wiring board, the power supply terminal including: a first terminal member having a plurality of first slits and a pair of first engaging portions; a plurality of press fit terminals each in substantially a U-shape inserted into the first slits of the first terminal member and having a plurality of press fit pins formed at an end portion of the press fit terminal; fixing means for fixing the press fit terminals to the first terminal member; a second terminal member having a plurality of second slits into which the press fit terminals are inserted, a plurality of third slits, and a pair of second engaging portions, the press fit terminals being partially inserted into the second slits and the second terminal member being attached to the first terminal member by engaging the second engaging portions with the first engaging portions; and an electronic part having a pair of plate springs each including an elastic deforming part and joined to both end portions of the electronic part, the electronic part being attached to the second terminal member by inserting the plate springs into the third slits, and the elastic deforming part of each of the plate springs being pressure-contacted with the adjacent press fit terminals when the second terminal member is attached to the first terminal member.

Preferably, the first terminal member has a screw hole, the press fit terminal has a hole formed in an intermediate portion of the press fit terminal, and the fixing means includes a screw screwed into the screw hole via the hole. Preferably, each of the first engaging portions includes an engaging hole, and each of the second engaging portions includes an engaging projection. Preferably, the power supply terminal further is a crimp contact fixed to the press fit terminal by the screw. Further, preferably, the electronic part is a surface mounting type capacitor.

In accordance with another aspect of the present invention, there is provided a power supply terminal for supplying power to a back wiring board, the power supply terminal including: a terminal member having a plurality of slits; a plurality of press fit terminals each in substantially a U-shape including a pair of side walls extending substantially in parallel with each other and an intermediate wall for connecting the side walls with each other, each of the side walls having a plurality of press fit pins formed at an end of the side wall and a pair of notches, and the side walls being inserted into the slits of the terminal member; fixing means for fixing the press fit terminals to the terminal member; and an electronic part having a pair of metallic frames, the metallic frames each having a pair of engaging pieces and a hole and being joined to both end portions of the electronic part, the electronic part being attached to the adjacent press fit terminals when the metallic frames are inserted into the notches and each of the side walls is interposed between the pair of engaging pieces.

In accordance with a further aspect of the present invention, there is provided a power supply terminal for supplying power to a back wiring board, the power supply terminal including: a terminal member having a plurality of slits; a plurality of press fit terminals each in substantially a U-shape having a plurality of press fit pins formed at an end portion of the press fit terminal and a pair of indentations formed in an inner surface of the press fit terminal, the press fit terminal being inserted into the slits of the terminal member; fixing means for fixing the press fit terminals to the terminal member; and an electronic part having a pair of plate springs, the plate springs each having a projection facing outward and being joined to both end portions of the electronic part, the electronic part being attached to the adjacent press fit terminals by fitting the projection to each of the indentations.

In accordance with a still further aspect of the present invention, there is provided a back wiring board assembly including: a back wiring board having a conductor pattern for supplying power and a plurality of through holes connected to the conductor pattern; and a power supply terminal press-fit-mounted in the through holes of the back wiring board; wherein the power supply terminal includes: a first terminal member having a plurality of first slits and a pair of first engaging portions; a plurality of press fit terminals each in substantially a U-shape inserted into the first slits of the first terminal member and having a plurality of press fit pins formed at an end portion of the press fit terminal; fixing means for fixing the press fit terminal to the first terminal member; a second terminal member having a plurality of second slits into which the press fit terminals are inserted, a plurality of third slits, and a pair of second engaging portions, the press fit terminals being partially inserted into the second slits and the second terminal member being attached to the first terminal member by engaging the second engaging portions with the first engaging portions; and an electronic part having a pair of plate springs each including an elastic deforming part and joined to both end portions of the electronic part, the electronic part being attached to the second terminal member by inserting the plate springs into the third slits, and the elastic deforming part of each of the plate springs being pressure-contacted with the adjacent press fit terminals when the second terminal member is attached to the first terminal member.

In accordance with a still further aspect of the present invention, there is provided a power supply terminal for supplying power to a back wiring board, said power supply terminal comprising: a first terminal member having a plurality of first slits and a pair of first engaging portions; a press fit terminal in substantially a U-shape inserted into said first slits of said first terminal member and having a plurality of press fit pins formed at an end portion of said press fit terminal; fixing means for fixing said press fit terminal to said first terminal member; a second terminal member having a pair of second engaging portions, a notch, and a second slit, said second terminal member being attached to said first terminal member by engaging said second engaging portions with said first engaging portions; and an electronic part having a first plate spring and a second plate spring each including an elastic deforming part and joined to both end portions of said electronic part, said electronic part being fitted into said notch of said second terminal member by inserting said second plate spring into said second slit, and the elastic deforming part of said first plate spring being pressed against said press fit terminal when said second terminal member is attached to said first terminal member.

In accordance with a still further aspect of the present invention, there is provided a back wiring board assembly comprising: a back wiring board having a conductor pattern for supplying power and through holes connected to said conductor pattern; and a power supply terminal press-fit-mounted in said through holes of said back wiring board; wherein said power supply terminal includes: a first terminal member having a plurality of first slits and a pair of first engaging portions; a press fit terminal in substantially a U-shape inserted into said first slits of said first terminal member and having a plurality of press fit pins formed at an end portion of said press fit terminal; fixing means for fixing said press fit terminal to said first terminal member; a second terminal member having a pair of second engaging portions, a notch, and a second slit, said second terminal member being attached to said first terminal member by engaging said second engaging portions with said first engaging portions; and an electronic part having a first plate spring and a second plate spring each including an elastic deforming part and joined to both end portions of said electronic part, said electronic part being fitted into said notch of said second terminal member by inserting said second plate spring into said second slit, and the elastic deforming part of said first plate spring being pressed against said press fit terminal and the elastic deforming part of said second plate spring being pressed against said conductor pattern of said back wiring board when said second terminal member is attached to said first terminal member.

In accordance with a still further aspect of the present invention, there is provided a back wiring board assembly comprising: a back wiring board having a conductor pattern for supplying power and through holes connected to said conductor pattern; and a power supply terminal press-fit-mounted in said through holes of said back wiring board; wherein said power supply terminal includes: a first terminal member having a plurality of first slits, a screw hole having a bottom, and a pair of first engaging portions; a press fit terminal in substantially a U-shape inserted into said first slits of said first terminal member and having a plurality of press fit pins formed at an end portion of said press fit terminal; a screw screwed into said screw hole, for fixing said press fit terminal to said first terminal member; a second terminal member having a pair of second engaging portions, a notch, and a pair of projections formed on wall surfaces forming said notch, said second terminal member being attached to said first terminal member by engaging said second engaging portions with said first engaging portions; and an electronic part having a first plate spring and a second plate spring joined to both end portions of said electronic part, said electronic part being attached to said second terminal member by inserting said electronic part into said notch and pressing said projections against side walls of said electronic part, and said first plate spring being pressed against the bottom said screw hole and said second plate spring being pressed against said conductor pattern of said back wiring board when said second terminal member is attached to said first terminal member.

In accordance with a still further aspect of the present invention, there is provided a back wiring board assembly comprising: a back wiring board having a conductor pattern for supplying power and through holes connected to said conductor pattern; and a power supply terminal press-fit-mounted in said through holes of said back wiring board; wherein said power supply terminal includes: a terminal member having a plurality of slits and a through screw hole; a press fit terminal in substantially a U-shape inserted into said slits of said terminal member and having a plurality of press fit pins formed at an end portion of said press fit terminal; a screw screwed into said screw hole, for fixing said press fit terminal to said terminal member; an electronic part having a first electrode and a second electrode at both ends of said electronic part, said electronic part being inserted into said screw hole; and a conductive elastic member interposed between said screw and said electronic part or between said electronic part and said back wiring board, for establishing electric connection of said first electrode with said screw or electric connection of said second electrode with said conductor pattern of said back wiring board.

In accordance with a still further aspect of the present invention, there is provided a back wiring board assembly comprising: a back wiring board having a conductor pattern for supplying power and through holes connected to said conductor pattern; and a power supply terminal press-fit-mounted in said through holes of said back wiring board; wherein said power supply terminal includes: a terminal member having a plurality of slits and a through screw hole; a press fit terminal in substantially a U-shape inserted into said slits of said terminal member and having a plurality of press fit pins formed at an end portion of said press fit terminal; a screw screwed into said screw hole, for fixing said press fit terminal to said terminal member; an electronic part having a first electrode and a second electrode at both ends of said electronic part, said electronic part being inserted into said screw hole; a first conductive elastic member interposed between said first electrode and said screw, for establishing electric connection of said first electrode with said screw; and a second conductive elastic member interposed between said second electrode and said back wiring board, for establishing electric connection of said second electrode with said conductor pattern of said back wiring board.

In accordance with a still further aspect of the present invention, there is provided a power supply terminal comprising: a first terminal member having a pair of engaging portions and accommodating at least two power terminals; a substrate having a conductive pattern and connected to the leading end of said power terminals; and an electronic part electrically connected to said first terminal and said substrate by elastically deforming between said power terminals.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Figure 1:
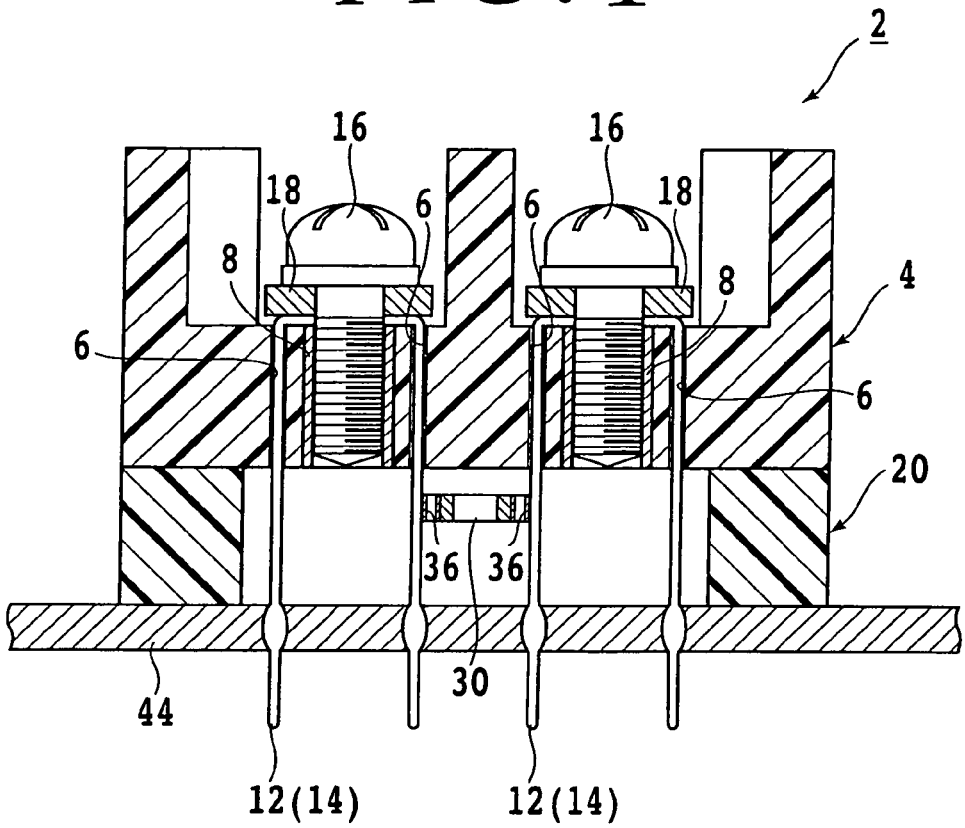
FIG. 1 is a sectional view of a power supply terminal according to a first embodiment of the present invention.

FIG. 1 is a sectional view of a power supply terminal 2 according to a first embodiment of the present invention. The power supply terminal 2 has a first terminal block (terminal member) 4 and a second terminal block (terminal member) 20 fitted to the first terminal block 4. These first and second terminal blocks 4 and 20 are formed of polybutylene terephthalate (PBT), for example. However, the first and second terminal blocks 4 and 20 are not limited to PBT, and a material having an insulating property and providing ease of work can be used without limitation.

Figure 2:
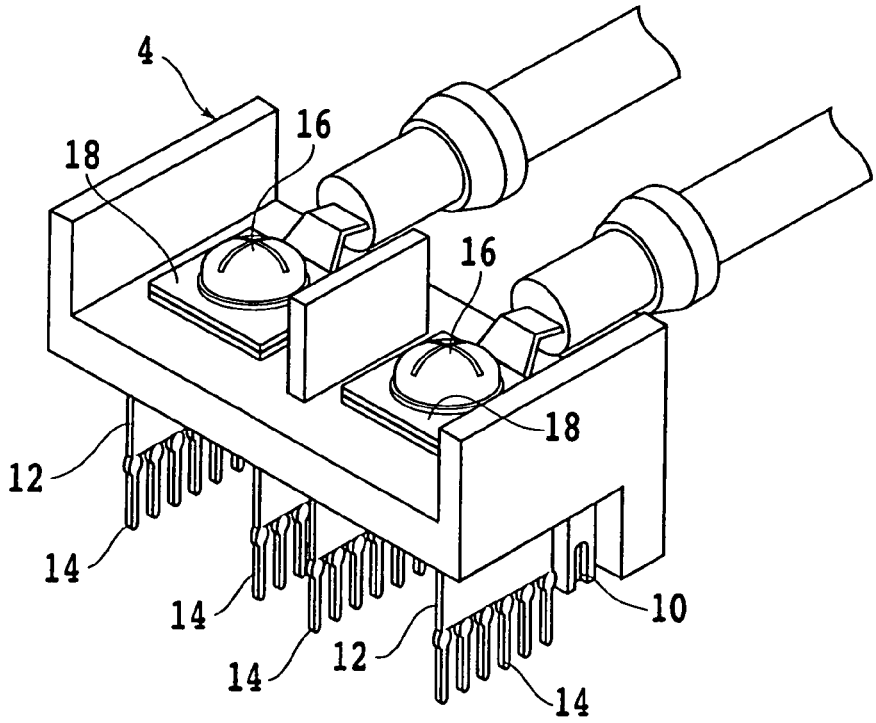
FIG. 2 is a perspective view of a first terminal block to which press fit terminals are attached.
Figure 3:
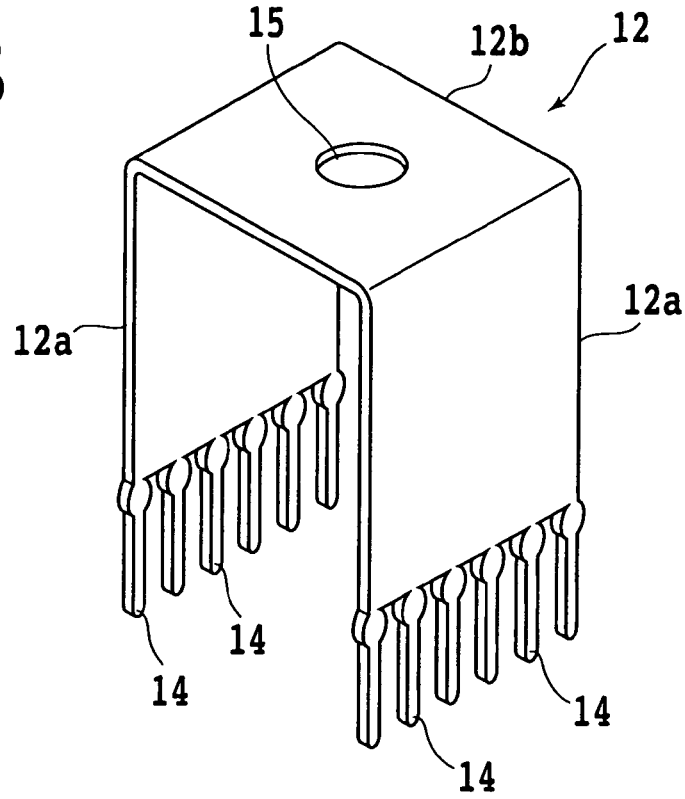
FIG. 3 is a perspective view of a press fit terminal.

In the first terminal block 4, a plurality of slits 6 into which press fit terminals 12 are inserted and insert-molded female screws 8 are formed. In addition, as shown in FIG. 2, a pair of engaging holes (only one is shown in the figure) 10 is formed on both sides of the first terminal block 4. The press fit terminals 12 are inserted into the slits 6 of the first terminal block 4. The press fit terminals 12 are bent in substantially a U-shape as shown in FIG. 3, and have a pair of side walls 12*a* and an intermediate wall 12*b* for connecting the side walls with each other. Each of the side walls 12*a* has a plurality of press fit pins 14 integrally formed at an end of the side wall. The intermediate wall 12*b* has a fixing hole 15 formed therein.

A material having a high conductivity and a certain degree of mechanical strength can be used as material for the press fit terminals 12; for example, a nickel-plated phosphor bronze or the like can be used as material for the press fit terminals 12. As shown in FIG. 1 and FIG. 2, the press fit terminals 12 are inserted into the slits 6 of the first terminal block 4, and by screwing male screws 16 into the female screws 8 with crimp contacts 18 interposed therebetween, the press fit terminals 12 are firmly fixed to the first terminal block 4. The crimp contacts 18 are connected to a power supply or a ground.

Figure 4:
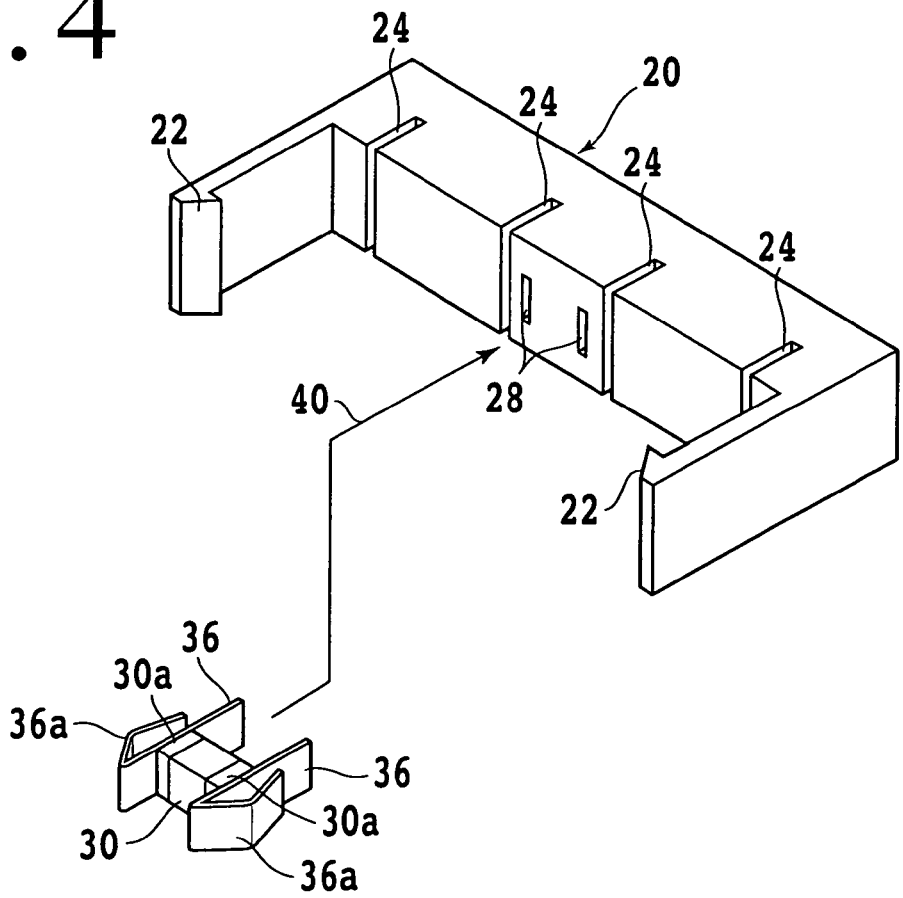
FIG. 4 is a diagram showing a state in which electronic parts are being attached to a second terminal block.

FIG. 4 illustrates a method of attaching electronic part 30 to the second terminal block (second terminal member) 20. The electronic part 30 is for example a surface mounting type capacitor, but is not limited to this. The capacitor 30 has a pair of electrodes 30*a* on both sides of the capacitor 30. A plate spring 36 having an elastic deforming part 36*a* is fixed by soldering or the like to each of the electrodes 30*a* disposed on both sides of the capacitor 30. The second terminal block 20 has a plurality of slits 24 into which the press fit terminals 12 are partially inserted, and a plurality of slits 28 into which the plate springs 36 of the capacitor 30 are inserted. In addition, engaging projections 22 that can engage with the engaging holes 10 shown in FIG. 2 are formed on both sides of an end portion of the second terminal block 20.

Figure 5:
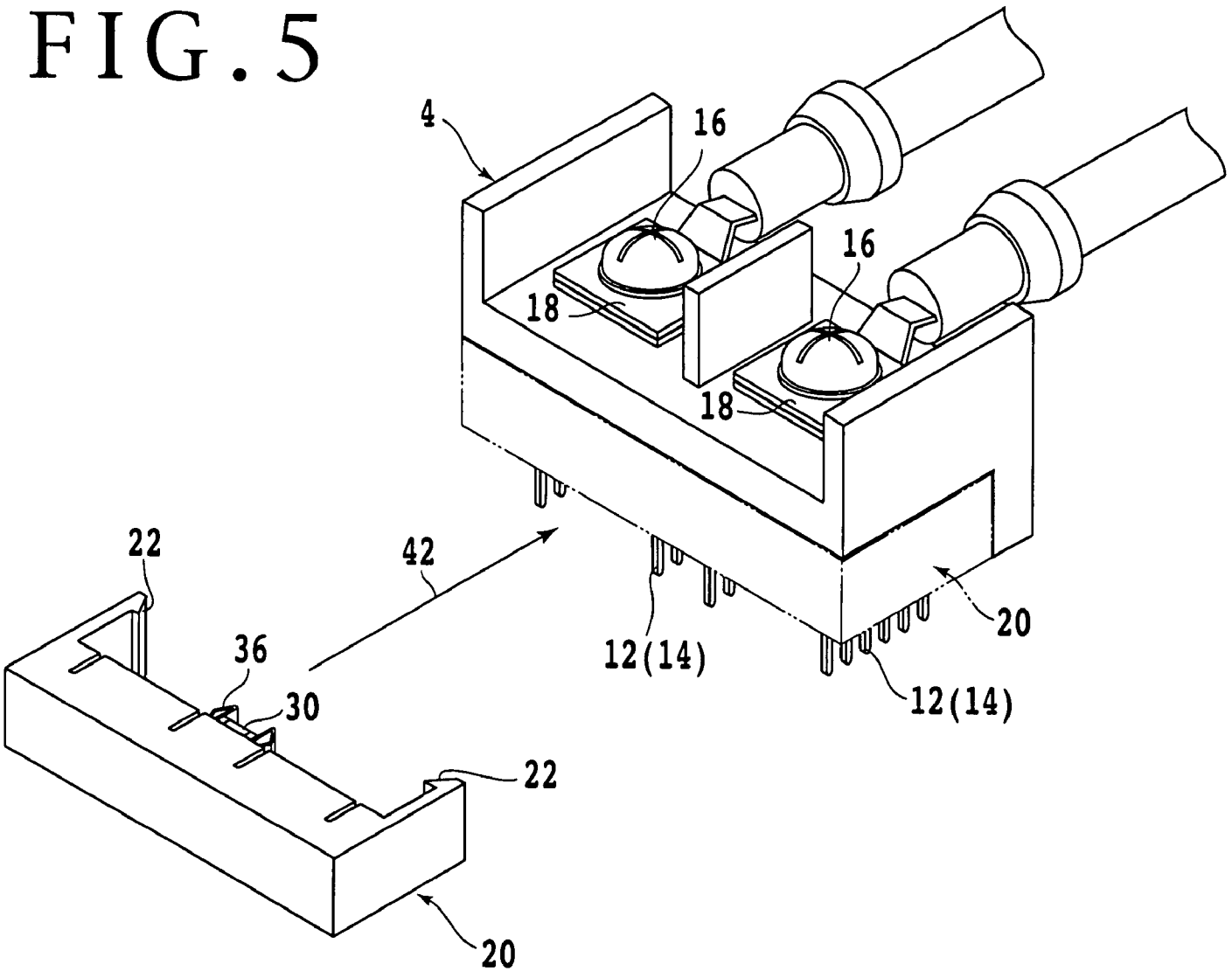
FIG. 5 is a diagram showing a state in which the second terminal block is fitted to the first terminal block.

The plate springs 36 of the capacitor 30 are inserted into the slits 28 as indicated by an arrow 40, whereby the capacitor 30 is attached to the second terminal block 20. As shown in FIG. 5, the second terminal block 20 having the capacitor 30 attached thereto is inserted into a portion of space on a lower side of the first terminal block 4 from a direction of a side of the first terminal block 4 as indicated by an arrow 42, and the engaging projections 22 are engaged with the engaging holes 10, whereby the second terminal block 20 is attached to the first terminal block 4. This state is shown in the sectional view of FIG. 1.

When the second terminal block 20 is attached to the first terminal block 4, the elastic deforming parts 36*a* of the plate springs 36 of the capacitor 30 are pressure-contacted with an outer surface of the press fit terminal 12. A back wiring board (BWB) 44 has a conductor pattern for power supply and a plurality of through holes connected to the conductor pattern. By inserting the press fit pins 14 of the press fit terminals 12 into the through holes of the BWB 44, the power supply terminal 2 is mounted on the BWB 44. Since the capacitor 30 is pressure-contacted with the press fit terminals 12, the capacitor 30 is connected to the power supply conductor pattern of the BWB 44 via the press fit terminals 12.

According to the first embodiment, it is possible to arrange the capacitor 30 in contact with the press fit terminals 12, thus construct a noise filter circuit using the capacitor 30, and provide sufficient noise filter characteristics.

Figure 6:
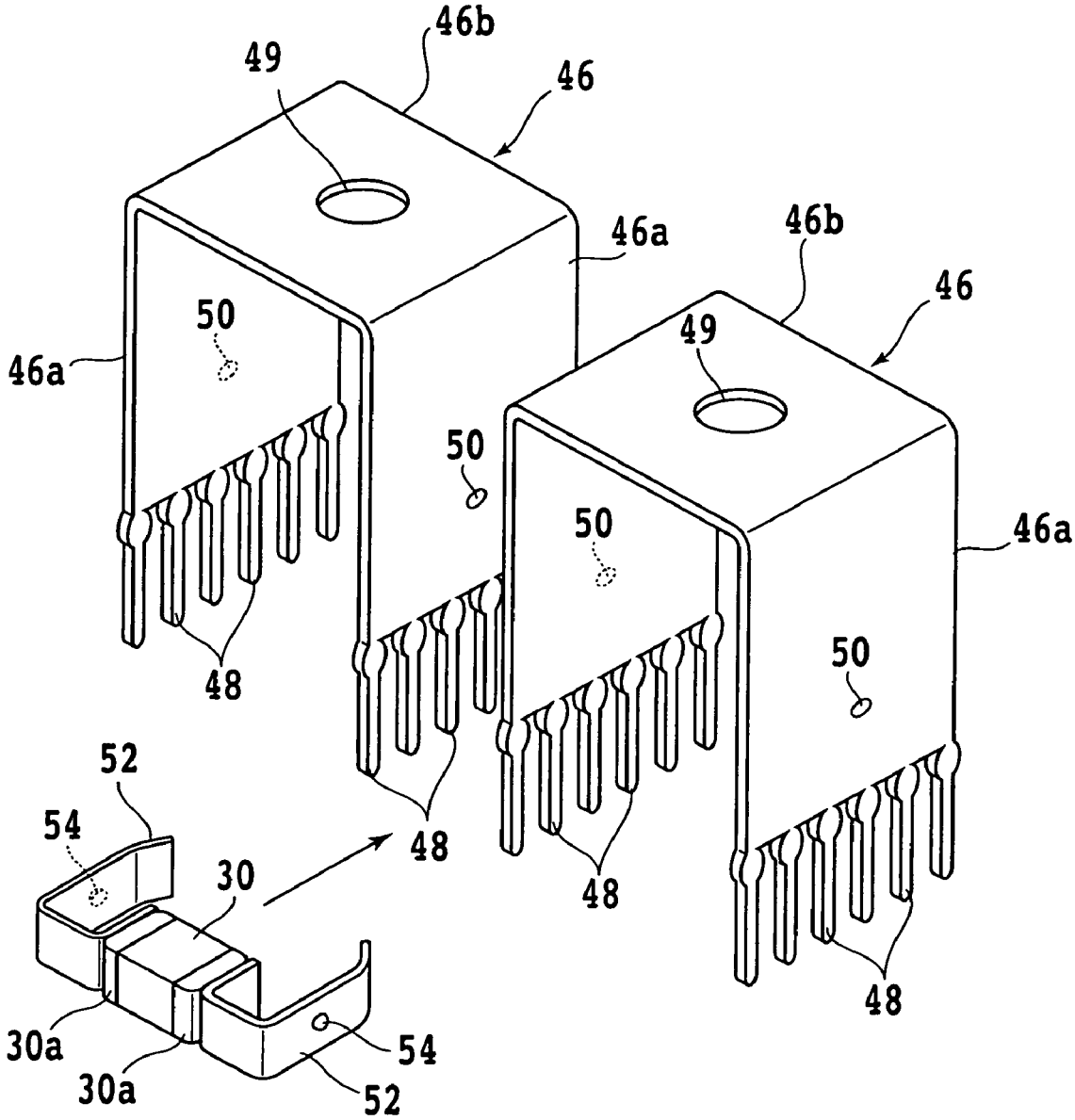
FIG. 6 is a diagram showing a press fit terminal and an electronic part that are suitable for use in a power supply terminal according to a second embodiment of the present invention.

FIG. 6 shows press fit terminals 46 and an electronic part 30 such as a surface mounting type capacitor or the like that are usable for a power supply terminal according to a second embodiment of the present invention. The press fit terminal 46 is bent in substantially a U-shape, and has a pair of side walls 46*a* and an intermediate wall 46*b* for connecting the side walls 46*a* with each other. Each of the side walls 46*a* has a plurality of press fit pins 48 integrally formed at an end of the side wall.

The press fit terminal 46 is formed of a phosphor bronze, for example, and has surfaces thereof nickel-plated. The intermediate wall 46*b* of the press fit terminal 46 has a fixing hole 49 formed therein. An engaging hole 50 is formed in an outer surface of each of the side walls 46*a*. A plate spring 52 bent in substantially an L-shape is fixed by soldering or the like to an electrode 30*a* disposed on both sides of the capacitor 30. An engaging projection 54 is formed on an outer surface of each plate spring 52.

Though not specifically shown, the press fit terminal 46 according to the second embodiment is inserted into slits 6 of a first terminal block 4 similar to that shown in FIG. 1, and the press fit pins 48 are press-inserted into through holes of a BWB 44. The capacitor 30 is inserted into the press fit terminal 46 from a direction of a side of the press fit terminal 46, and the engaging projection 54 is engaged with the engaging hole 50, whereby the capacitor 30 is mounted between the adjacent press fit terminals 46.

Also in the second embodiment, since the capacitor 30 is directly mounted between the adjacent press fit terminals 46, it is possible to use a high-frequency capacitor, and provide sufficient noise filter characteristics.

Figure 7A:
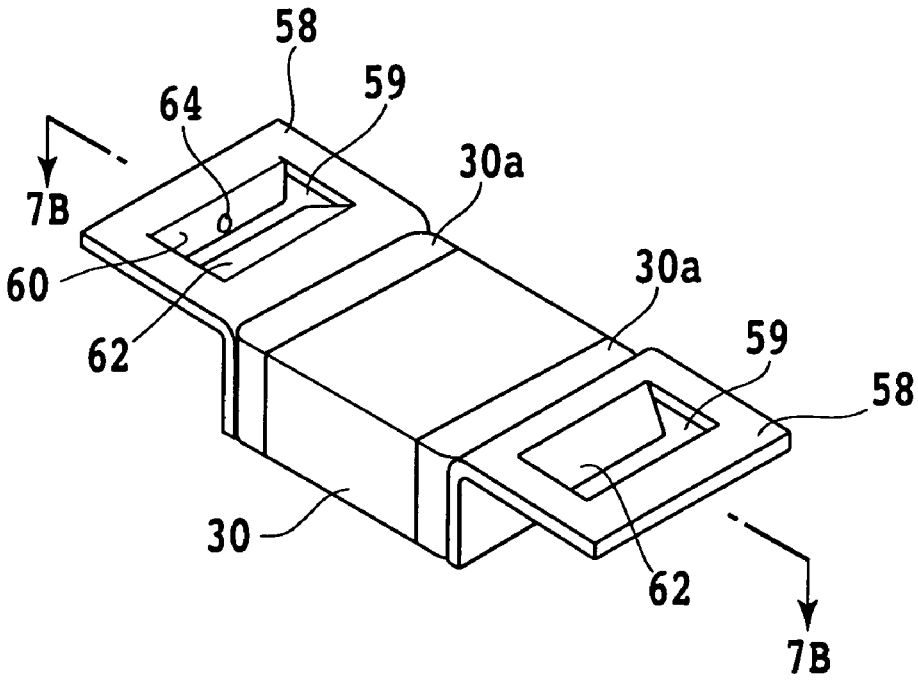
FIG. 7A is a perspective view of an electronic part suitable for use in a power supply terminal according to a third embodiment of the present invention.
Figure 7B:
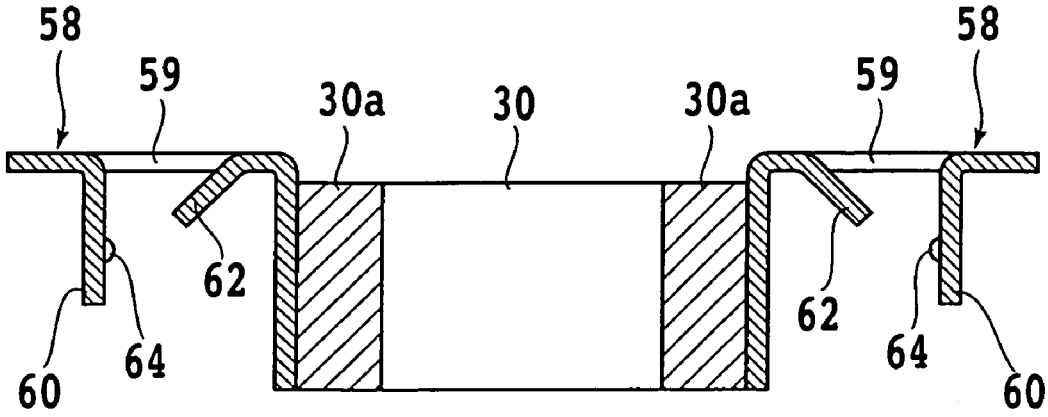
FIG. 7B is a sectional view taken along a line 7B-7B in FIG. 7A.

FIG. 7A is a perspective view of an electronic part suitable for use in a power supply terminal according to a third embodiment of the present invention. FIG. 7B is a sectional view taken along a line 7B-7B in FIG. 7A. The electronic part 30 comprises a surface mounting type capacitor, for example. In the third embodiment, description will be made of an example where the surface mounting type capacitor is used as the electronic part 30. The capacitor 30 has electrodes 30*a* disposed on both sides of the capacitor 30. A metallic frame 58 is fixed to each of the electrodes 30*a* by soldering or the like. Each metallic frame 58 has a rectangular hole 59 and a pair of engaging pieces 60 and 62. The engaging piece 62 is formed with an inclination so that an end of the engaging piece 62 is close to the engaging piece 60. An engaging projection 64 is formed on an inner surface of the engaging piece 60.

Figure 8:
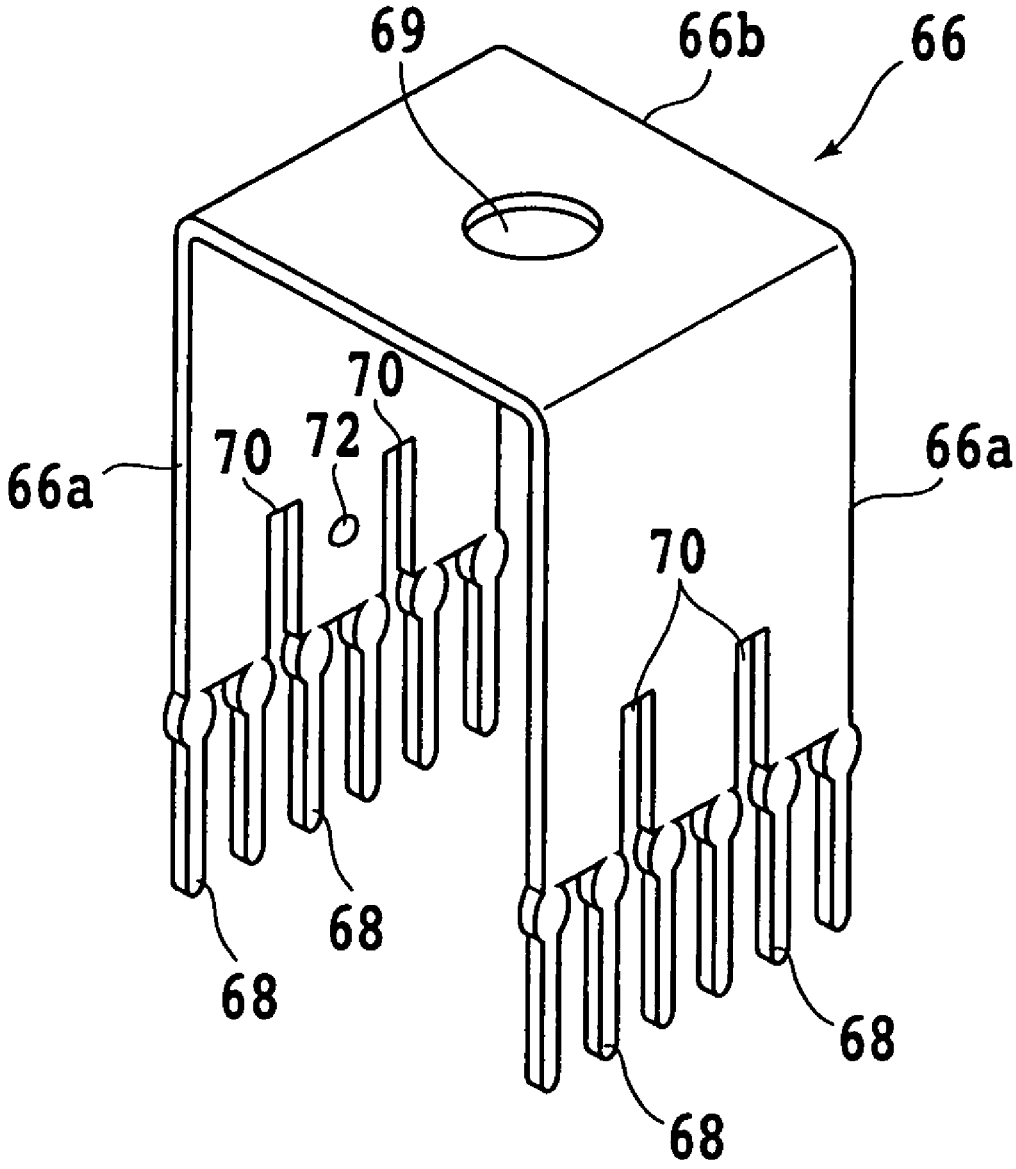
FIG. 8 is a perspective view of a press fit terminal suitable for use in the power supply terminal according to the third embodiment of the present invention.

FIG. 8 shows a press fit terminal 66 suitable for use in the power supply terminal according to the third embodiment of the present invention. The press fit terminal 66 is bent in substantially a U-shape, and has a pair of side walls 66*a* and an intermediate wall 66*b* for connecting the side walls 66*a* with each other. Each of the side walls 66*a* has a plurality of press fit pins 68 integrally formed at an end of the side wall, and a pair of notches 70. An engaging hole 72 is formed in an inner surface of each of the side walls 66*a*. The intermediate wall 66*b* has a fixing hole 69. As with the press fit terminals in the foregoing first and second embodiments, the press fit terminal 66 in the third embodiment is formed of a phosphor bronze, for example, and has surfaces thereof nickel-plated.

Figure 9:
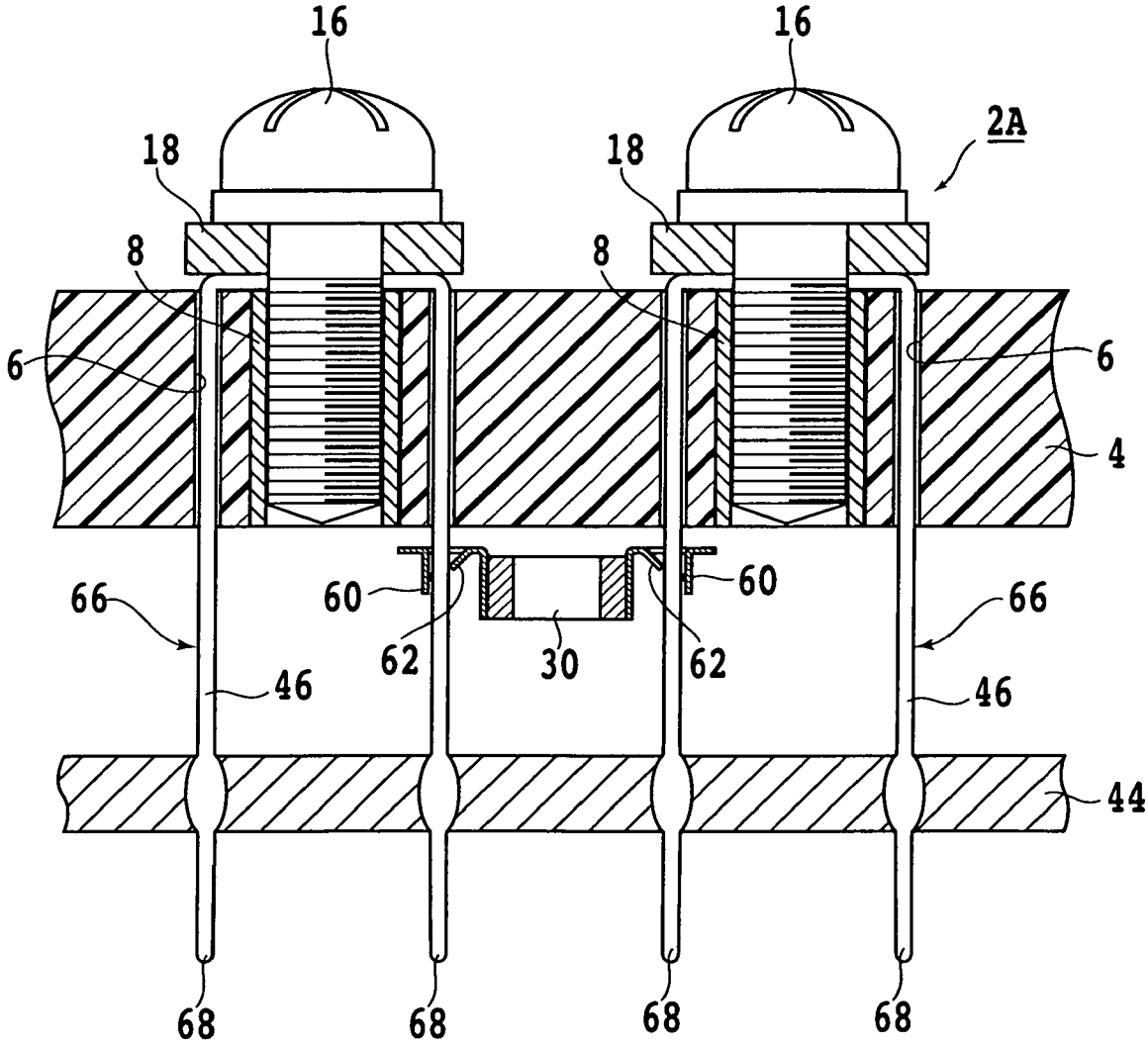
FIG. 9 is a sectional view of the third embodiment of the present invention.

FIG. 9 is a sectional view of the power supply terminal 2A according to the third embodiment of the present invention. In assembly of the power supply terminal 2A according to the third embodiment, first the press fit terminals 66 are inserted into slits 6 of a terminal block 4. By then screwing a male screw 16 into a female screw 8 with a crimp contact 18 interposed therebetween, each of the press fit terminals 66 are fixed to the terminal block 4 together with the crimp contact 18. Next, the capacitor 30 is inserted from an end side of the press fit pins 68 such that the press fit pins 68 do not interfere with the metallic frames 58 disposed on both sides of the capacitor 30. The metallic frames 58 are further inserted fully into the pair of notches 70.

In this state, the engaging projections 64 of the metallic frames 58 are engaged with the engaging holes 72 formed in the inner surface of the press fit terminal 66, whereby the capacitor 30 is mounted between the adjacent press fit terminals 66. When the press fit pins 68 are press-inserted into through holes of a BWB 44 after completion of the mounting of the capacitor 30 between the press fit terminals 66, the power supply terminal 2A is mounted on the BWB 44.

Figure 10:
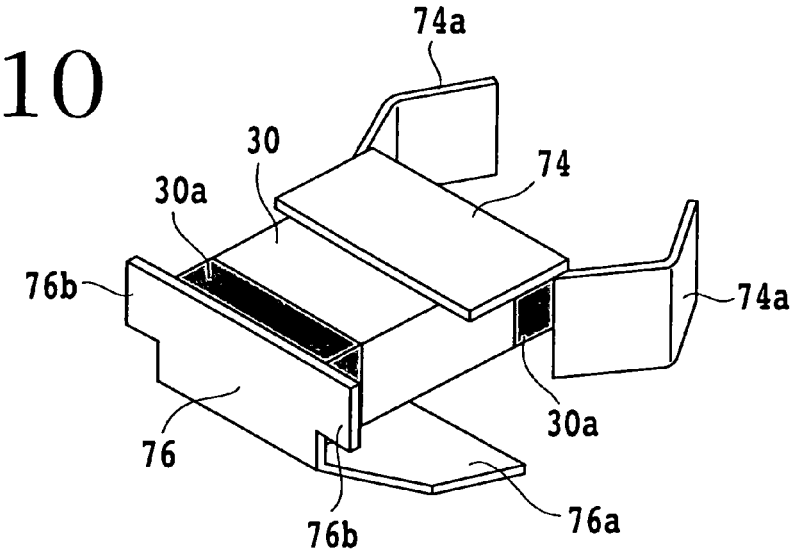
FIG. 10 is a perspective view of an electronic part suitable for use in a power supply terminal according to a fourth embodiment of the present invention.
Figure 11:
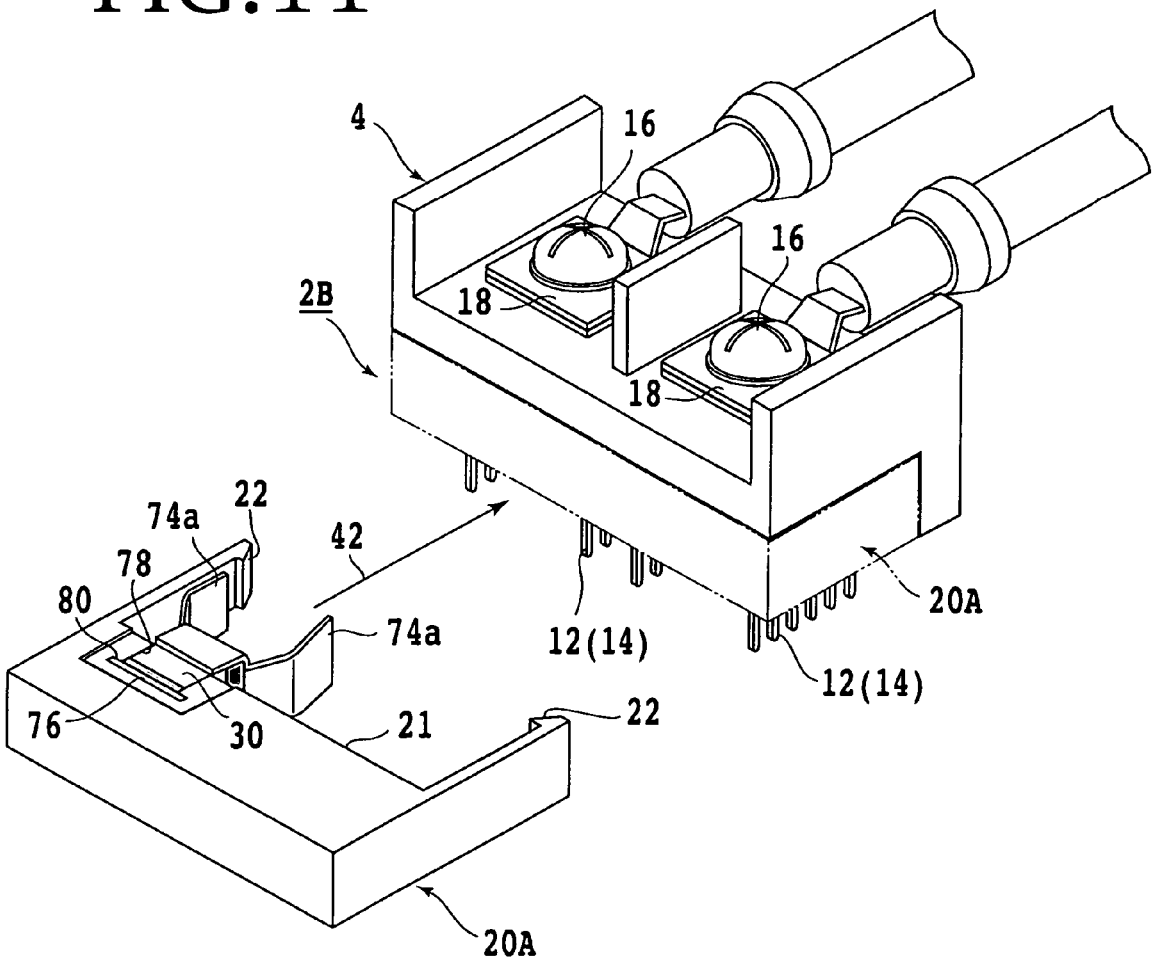
FIG. 11 is a diagram showing a state in which a second terminal member is fitted to a first terminal member in the power supply terminal according to the fourth embodiment of the present invention.

FIG. 10 is a perspective view of an electronic part for use in a power supply terminal according to a fourth embodiment of the present invention. The electronic part 30 includes a surface mounting type capacitor, and has a pair of electrodes 30*a* at both end portions thereof. The electrodes 30*a* are joined with plate springs 74 and 76 having elastic deforming parts 74*a* and 76*a*, respectively, by soldering, for example. As shown in FIG. 11, a second terminal block (second terminal member) 20A has a notch portion 21 for accommodating press fit pins 14 when the second terminal block 20A is attached to a first terminal block 4. The second terminal block 20A also has a step at a portion for accommodating the electronic part 30 so that the elastic deforming part 74*a* of the electrode 30*a* is level with an upper surface of the second terminal block 20A. The second terminal block 20A further has a notch 78 for accommodating the capacitor 30, and a slit 80 for inserting both end portions 76*b* of the plate spring 76 in the step portion. Incidentally, when the elastic deforming part 74*a* is of a thin material and hence the step does not need to be provided, the step may be omitted.

The capacitor 30 is inserted into the notch 78 from a direction of a top of FIG. 11, and the capacitor 30 is attached to the second terminal block 20A by fitting both the end portions 76*b* of the plate spring 76 into the slit 80. As shown in FIG. 11, the second terminal block 20A having the capacitor 30 attached thereto is inserted into a lower side space portion of the first terminal block 4 from a direction of a side of the first terminal block 4 as indicated by an arrow 42. The second terminal block 20A is attached to the first terminal block 4 by engaging engaging projections 22 with engaging holes 10. When the second terminal block 20A is attached to the first terminal block 4, the press fit pins 14 are accommodated in the notch portion 21 of the second terminal block 20A, and the elastic deforming parts 74*a* of the plate spring 74 joined to the capacitor 30 are pressed against an inner surface of press fit terminals 12.

A BWB 44 has a conductor pattern for power supply and a plurality of through holes connected to the conductor pattern. By inserting the press fit pins 14 of the press fit terminals 12 into the through holes of the BWB 44, a power supply terminal 2B is mounted on the BWB 44. When the power supply terminal 2B is mounted on the BWB 44, the elastic deforming parts 74*a* of the plate spring 74 joined to the capacitor 30 are pressed against the press fit terminals 12, and the elastic deforming part 76*a* of the plate spring 76 is pressed against the conductor pattern of the BWB 44.

According to the fourth embodiment, it is possible to arrange the capacitor 30 in contact with the press fit terminals 12 and the conductor pattern of the BWB 44, thus construct a noise filter circuit using the capacitor 30 and provide sufficient noise filter characteristics.

Figure 12:
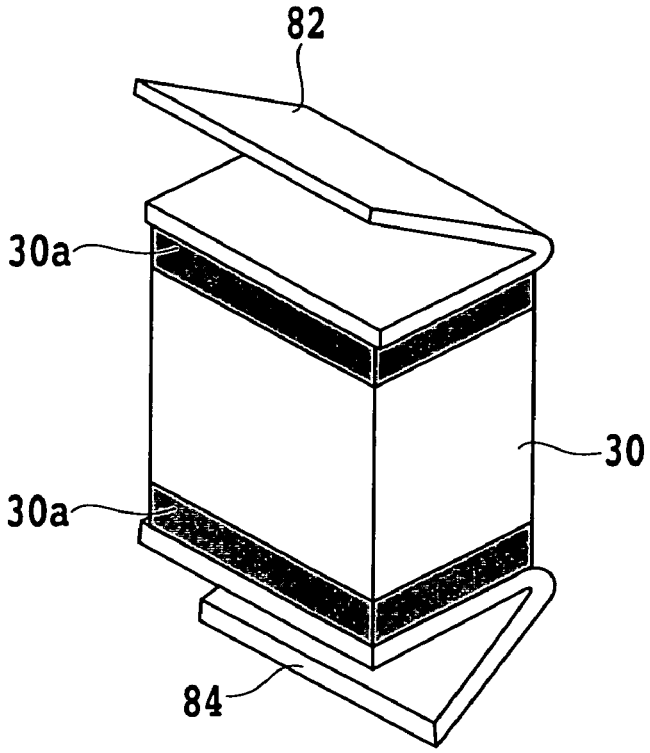
FIG. 12 is a perspective view of an electronic part suitable for use in a power supply terminal according to a fifth embodiment of the present invention.
Figure 13:
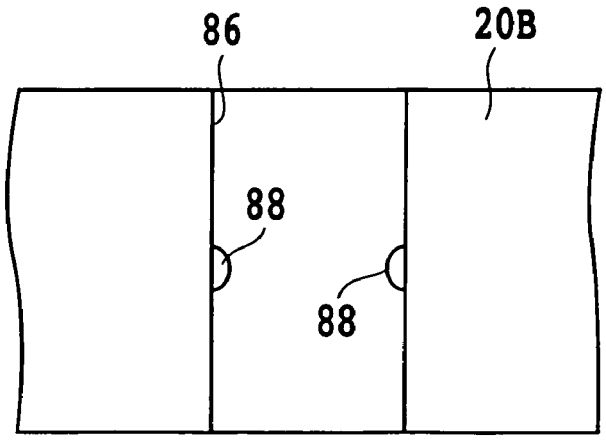
FIG. 13 is a front view of an electronic part fitting part of the fifth embodiment.

FIG. 12 is a perspective view of a surface mounting part for use in a power supply terminal according to a fifth embodiment of the present invention. The surface mounting part 30 includes a capacitor, and has plate springs 82 and 84 joined to electrodes 30*a* disposed at both ends of the capacitor. As shown in FIG. 13, a second terminal block 20B has a notch 86 for inserting the capacitor 30. A pair of projections 88 is formed on wall surfaces forming the notch 86 of the second terminal block 20B.

Figure 14:
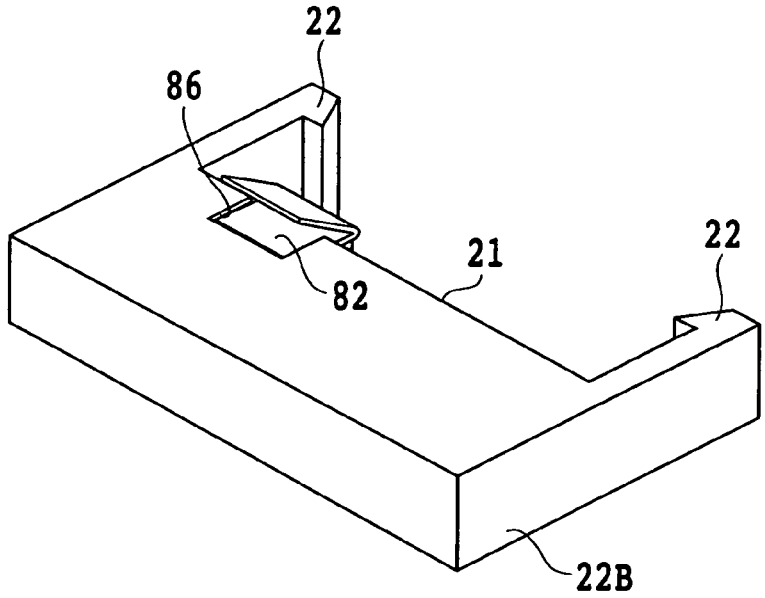
FIG. 14 is a perspective view of a second terminal member to which an electronic part is fitted.

As shown in FIG. 14, when the capacitor 30 is inserted into the notch 86 of the second terminal block 20B, the pair of projections 88 is pressed against side surfaces of the capacitor 30, whereby the capacitor 30 is attached to the second terminal block 20B.

Figure 15:
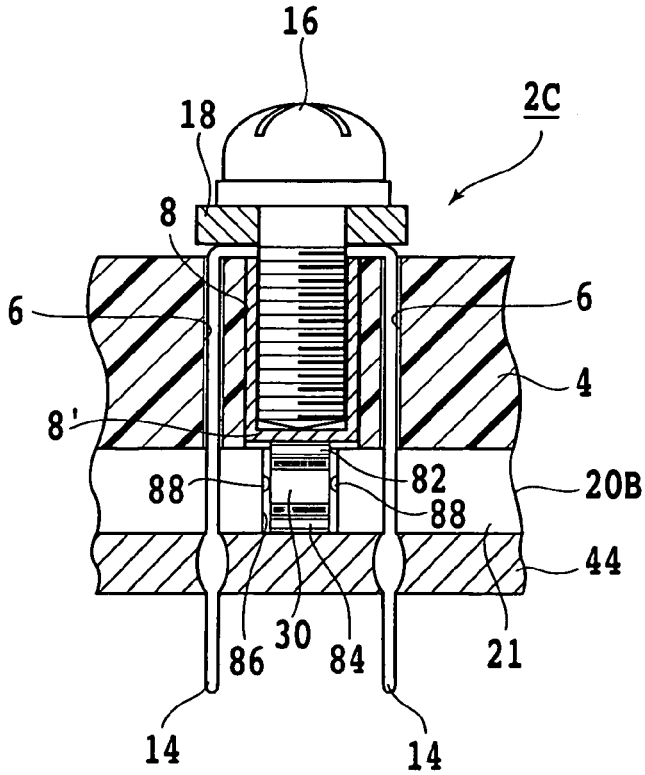
FIG. 15 is a sectional view of the power supply terminal according to the fifth embodiment of the present invention.

FIG. 15 is a sectional view of a power supply terminal 2C according to the fifth embodiment mounted on a BWB 44. In the fifth embodiment, the plate spring 82 joined to the capacitor 30 is pressed against a bottom plate 8' of a female screw 8, and the plate spring 84 is pressed against a conductor pattern formed on the BWB 44.

Figure 16:
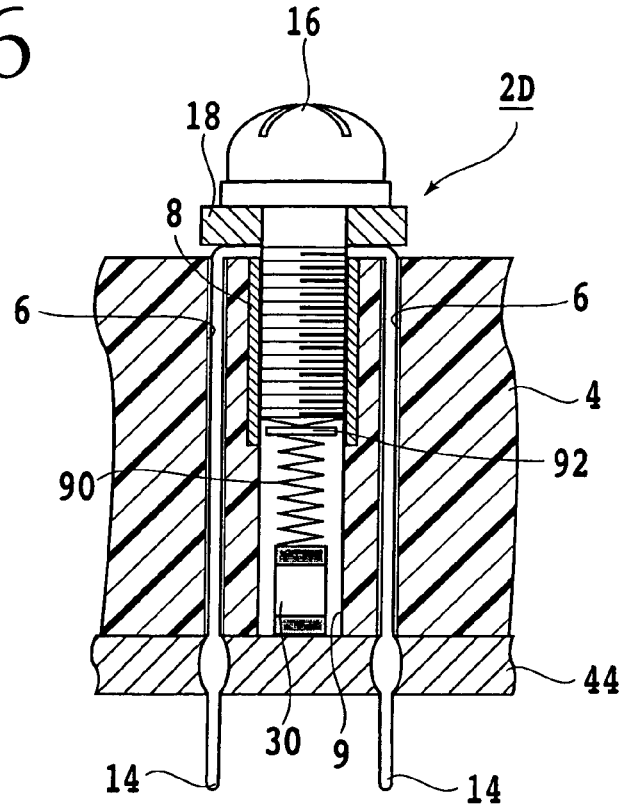
FIG. 16 is a sectional view of a power supply terminal according to a sixth embodiment of the present invention.

FIG. 16 is a sectional view of a power supply terminal 2D according to a sixth embodiment of the present invention. The sixth embodiment connects a capacitor 30 to a screw 16 and a conductor pattern of a BWB 44 without using a second terminal block. The same is true for embodiments shown in FIGS. 17 to 22. In the sixth embodiment shown in FIG. 16, a through hole 9 is formed at a bottom portion of a female screw 8 in a first terminal block 4. The capacitor 30, a coil spring 90, and a pressing plate 92 are put in the through hole 9. One electrode of the capacitor 30 is connected to the screw 16 via the coil spring 90 and the pressing plate 92, and another electrode of the capacitor 30 is connected to the conductor pattern of the BWB 44.

In assembling the power supply terminal 2D according to the sixth embodiment, press fit pins 14 of the first terminal block 4 are first pressed into through holes of the BWB 44. Next, the capacitor 30, the coil spring 90, and the pressing plate 92 are inserted into the hole 9. Finally, the male screw 16 is screwed into the female screw 8. The seventh to ninth embodiments shown in FIGS. 17 to 20 are assembled in a similar manner.

Figure 17:
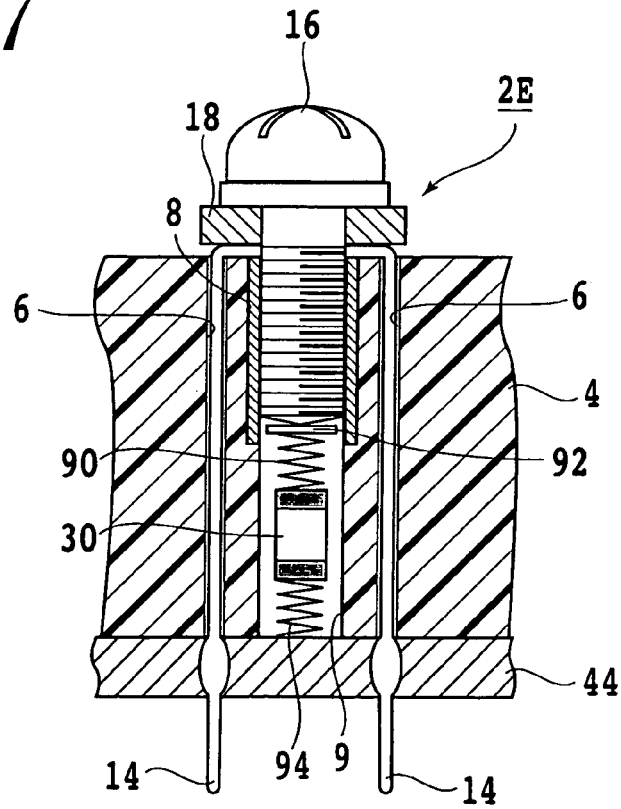
FIG. 17 is a sectional view of a power supply terminal according to a seventh embodiment of the present invention.

FIG. 17 is a sectional view of a power supply terminal 2E according to a seventh embodiment of the present invention. The seventh embodiment has coil springs 90 and 94 disposed on both sides of a capacitor 30. One electrode of the capacitor 30 is connected to a screw 16 via the coil spring 90 and a pressing plate 92, and another electrode of the capacitor 30 is connected to a conductor pattern of a BWB 44 via the coil spring 94.

Figure 18:
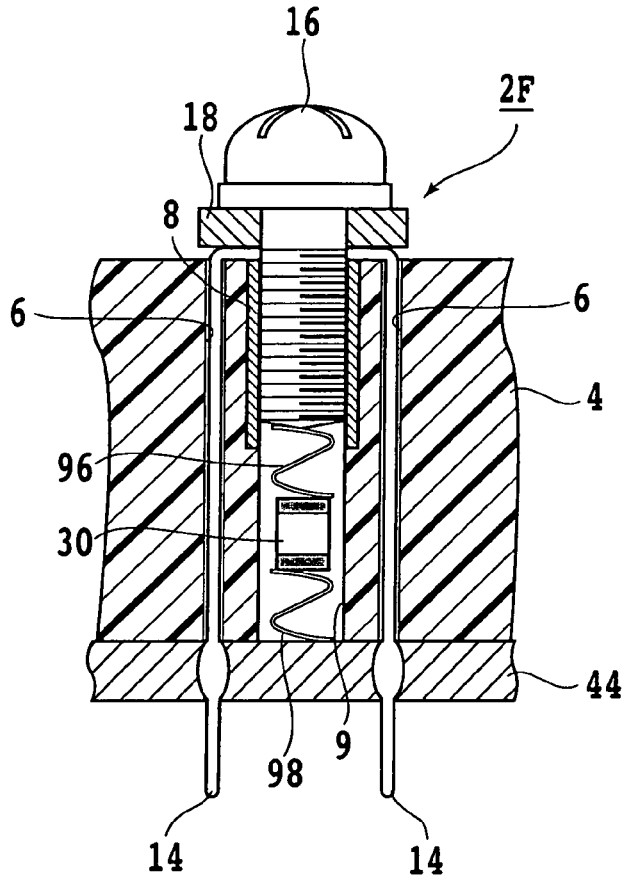
FIG. 18 is a sectional view of a power supply terminal according to an eighth embodiment of the present invention.
Figure 19:
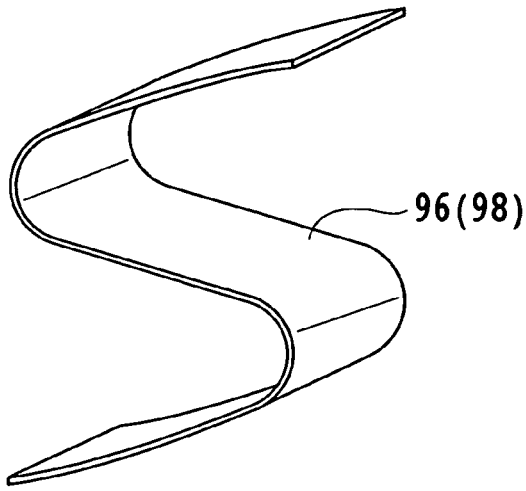
FIG. 19 is a perspective view of an S-shaped plate spring.

FIG. 18 is a sectional view of a power supply terminal 2F according to an eighth embodiment of the present invention. The eighth embodiment uses S-shaped plate springs 96 and 98 as shown in FIG. 19. One electrode of a capacitor 30 is connected to a screw 16 via the plate spring 96, and another electrode of the capacitor 30 is connected to a conductor pattern of a BWB 44 via the plate spring 98. The plate springs are not limited to the S shape; plate springs of a C shape, an N shape, a U shape, a V shape, a W shape and the like can be used.

Figure 20:
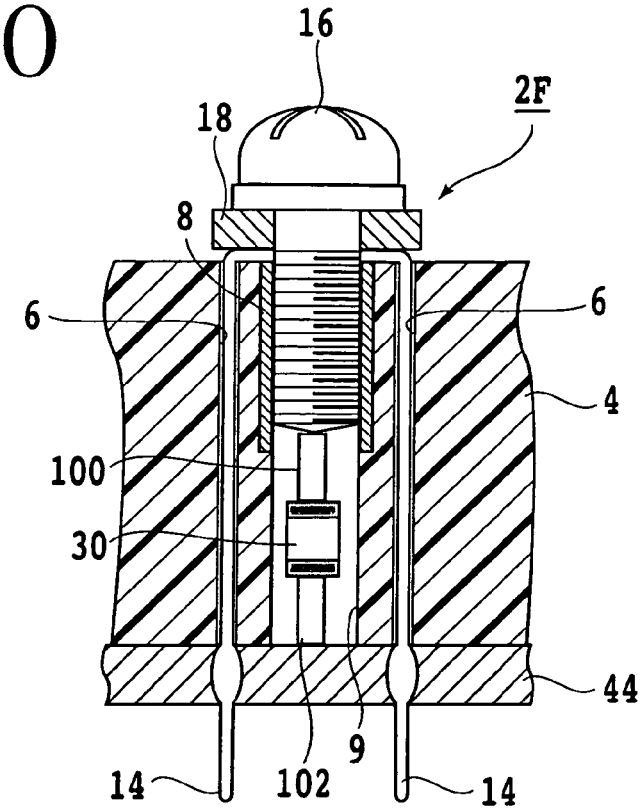
FIG. 20 is a sectional view of a power supply terminal according to a ninth embodiment of the present invention.

FIG. 20 is a sectional view of a power supply terminal 2G according to a ninth embodiment of the present invention. In the ninth embodiment, one electrode of a capacitor 30 is connected to a screw 16 via a conductive rubber 100, and another electrode of the capacitor 30 is connected to a conductor pattern of a BWB 44 via a conductive rubber 102.

A tenth embodiment and an eleventh embodiment of the present invention to be described below illustrate constructions where a coil spring 90 or plate springs 96 and 98 and a capacitor 30 are applied with a structure of a female screw 8 having a bottom portion as used in the fifth embodiment.

Figure 21:
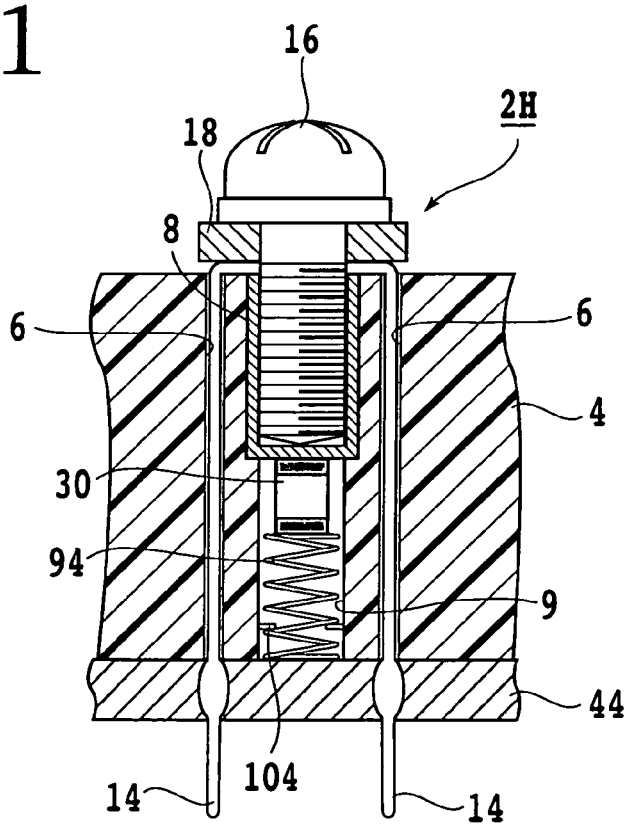
FIG. 21 is a sectional view of a power supply terminal according to a tenth embodiment of the present invention.

FIG. 21 is a sectional view of a power supply terminal 2H according to a tenth embodiment of the present invention. The tenth embodiment engages a coil spring 94 by an engaging metallic part 104 to prevent a capacitor 30 from falling off when a first terminal block 4 is mounted on a BWB 44.

Figure 22:
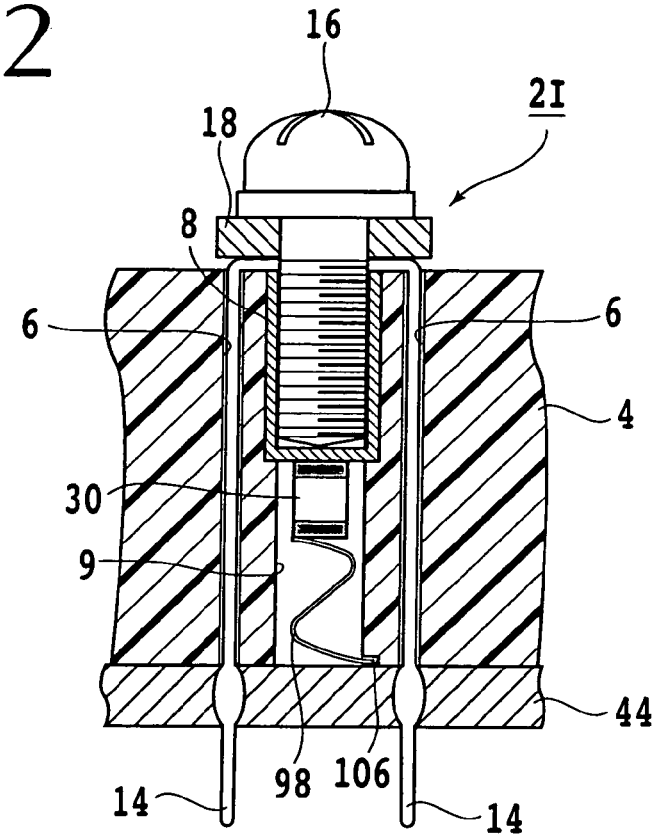
FIG. 22 is a sectional view of a power supply terminal according to an eleventh embodiment of the present invention.

FIG. 22 is a sectional view of a power supply terminal 2I according to an eleventh embodiment of the present invention. The eleventh embodiment has a groove 106 formed in a first terminal block 4. An end portion of a plate spring 98 is inserted into the groove 106 from a horizontal direction to temporarily fix the plate spring 98. A capacitor 30 is held so as not to fall off by thus temporarily fixing the plate spring 98 when press fit pins 14 of the first terminal block 4 are pressed into a BWB 44.

Figure 23:
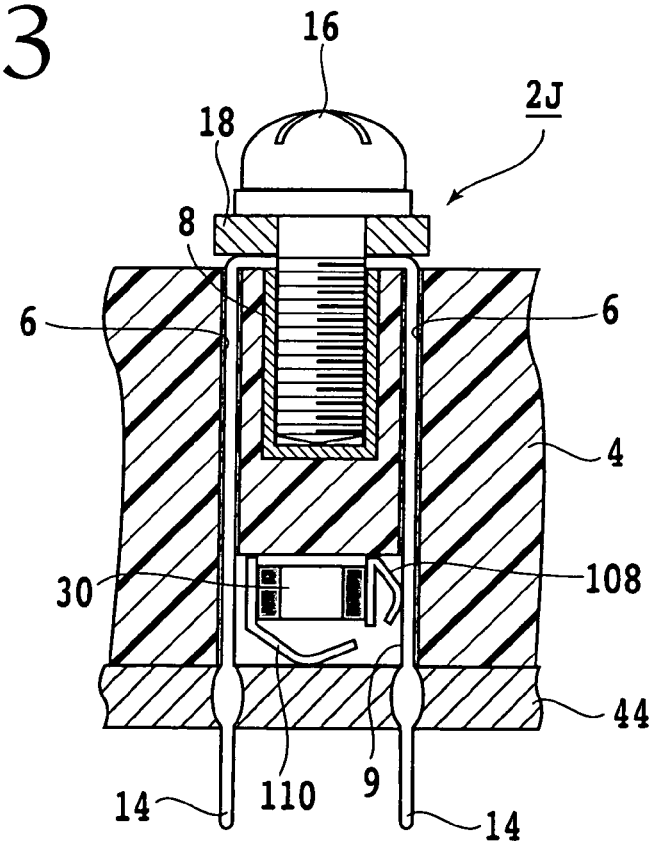
FIG. 23 is a sectional view of a power supply terminal according to a twelfth embodiment of the present invention.

FIG. 23 is a sectional view of a power supply terminal 2J according to a twelfth embodiment of the present invention. In the twelfth embodiment, plate springs 108 and 110 are joined to electrodes at both end portions of a capacitor 30. Press fit pins 14 of the power supply terminal 2J are pressed into through holes of a BWB 44 in a state in which an upper end portion of the plate spring 110 is temporarily fixed to a first terminal block 4. This state is shown in FIG. 23, in which one electrode of the capacitor 30 is connected to the press fit pins 14 via the plate spring 108, and another electrode of the capacitor 30 is connected to a conductor pattern of the BWB 44 via the plate spring 110.

It is to be noted that while the embodiments described above have two power supply terminals, the present invention is not limited to this, and is similarly applicable in cases where a larger number of power supply terminals are arranged.

With the power supply terminals according to the present invention, since the electronic part is directly mounted to the press fit terminal, it is possible to omit the conventionally required noise filter circuit board and thus simplify the structure of the power supply terminal. Further, since the electronic part is directly mounted to the press fit terminal without soldering, manufacturability of the power supply terminal can be improved.

Since the electronic part is directly mounted to the press fit terminal, it is possible to use a high-frequency capacitor as the electronic part, and provide sufficient noise filter characteristics. Further, incorporation of the electronic part from a direction of a side of the press fit terminal facilitates replacement, change, and the like of the electronic part even after the power supply terminal is mounted on the BWB.

What is claimed is:

1. A power supply terminal for supplying power to a back wiring board, said power supply terminal comprising:

a first terminal member having a plurality of first slits and a pair of first engaging portions;

a plurality of press fit terminals each in substantially a U-shape inserted into said first slits of said first terminal member and having a plurality of press fit pins formed at an end portion of the press fit terminal;

fixing means for fixing said press fit terminals to said first terminal member;

a second terminal member having a plurality of second slits into which said press fit terminals are inserted, a plurality of third slits, and a pair of second engaging portions, said press fit terminals being partially inserted into said second slits and the second terminal member being attached to said first terminal member by engaging said second engaging portions with said first engaging portions; and an electronic part having a pair of plate springs each including an elastic deforming part and joined to both end portions of the electronic part, said electronic part being attached to said second terminal member by inserting said plate springs into said third slits, and the elastic deforming part of each of said plate springs being pressure-contacted with adjacent press fit terminals when said second terminal member is attached to said first terminal member.

2. A power supply terminal as claimed in claim 1, wherein said first terminal member has a plurality of screw holes, each of said press fit terminals has a hole formed in an intermediate portion of each said press fit terminal, and said fixing means comprises a screw screwed into each of said screw holes via said hole.

3. A power supply terminal as claimed in claim 1, wherein each of said first engaging portions comprises an engaging hole, and each of said second engaging portions comprises an engaging projection.

4. A power supply terminal as claimed in claim 2, further comprising a crimp contact fixed to said press fit terminal by said screw.

5. A power supply terminal as claimed in claim 1, wherein said second terminal member is engaged with and fixed to said first terminal member from a direction orthogonal to a direction in which said press fit terminal extends.

6. A power supply terminal as claimed in claim 1, wherein said electronic part comprises a surface mounting type capacitor.

7. A power supply terminal as claimed in claim 6, wherein said terminal member has a plurality of screw holes, each of said press fit terminal has a hole formed in an intermediate portion of said press fit terminal, and said fixing means comprises a screw screwed into each of said screw holes via said hole.

8. A back wiring board assembly comprising:

a back wiring board having a conductor pattern for supplying power and a plurality of through holes connected to said conductor pattern; and a power supply terminal press-fit-mounted in said through holes of said back wiring board;

wherein said power supply terminal comprises:

a first terminal member having a plurality of first slits and a pair of first engaging portions;

a plurality of press fit terminals each in substantially a U-shape inserted into said first slits of said first terminal member and having a plurality of press fit pins formed at an end portion of the press fit terminal;

fixing means for fixing said press fit terminals to said first terminal member;

a second terminal member having a plurality of second slits into which said press fit terminals are inserted, a plurality of third slits, and a pair of second engaging portions, said press fit terminals being partially inserted into said second slits and the second terminal member being attached to said first terminal member by engaging said second engaging portions with said first engaging portions; and an electronic part having a pair of plate springs each including an elastic deforming part and joined to both end portions of the electronic part, said electronic part being attached to said second terminal member by inserting said plate springs into said third slits, and the elastic deforming part of each of said plate springs being pressure-contacted with adjacent press fit terminals when said second terminal member is attached to said first terminal member.

* * * * *